US006935211B2

(12) United States Patent
Chen

(10) Patent No.: US 6,935,211 B2
(45) Date of Patent: Aug. 30, 2005

(54) RATCHET TOOL HAVING IMPROVED DRIVING SHANK

(76) Inventor: Su Shia Chen, 1F, No. 23, Bien Hsin Lane, Wu Zh Hsiang, Taichung Hsien (TW) 414

( * ) Notice: Subject to any disclaimer, the term of this patent is extended or adjusted under 35 U.S.C. 154(b) by 10 days.

(21) Appl. No.: 10/763,454

(22) Filed: Jan. 20, 2004

(65) Prior Publication Data

US 2005/0155462 A1 Jul. 21, 2005

(51) Int. Cl.[7] ..... B25B 13/00
(52) U.S. Cl. ..... 81/58.4; 81/60; 81/438
(58) Field of Search ..... 81/58, 58.3, 58.4, 81/60–63.2, 117.85, 438

(56) References Cited

U.S. PATENT DOCUMENTS 1,578,114 A * 3/1926 Fegley ..... 81/124.6
4,781,085 A * 11/1988 Fox, III ..... 81/177.85
4,962,682 A * 10/1990 Rose et al. ..... 81/177.85
5,570,616 A 11/1996 Thompson et al. ..... 81/63.1
5,687,820 A 11/1997 Lin ..... 192/43.2
5,943,924 A * 8/1999 Jarvis ..... 81/177.2
5,964,132 A 10/1999 Chen ..... 81/439
6,047,802 A 4/2000 Huang ..... 192/43.2
6,058,812 A 5/2000 Casel et al. ..... 81/60
6,151,994 A * 11/2000 Shiao ..... 81/61
6,260,452 B1 * 7/2001 Yu ..... 81/177.2
6,622,597 B2 9/2003 Chen ..... 81/58.3

* cited by examiner

*Primary Examiner*—David B. Thomas
(74) *Attorney, Agent, or Firm*—Charles E. Baxley

(57) ABSTRACT

A ratchet tool includes a seat rotatably secured to a housing and having a number of teeth, a driving stem is engaged in the seat and has an engaging hole to receive a tool member, two pawls are slidably engaged in the housing and biased to engage with the teeth of the seat. A device may selectively disengage the pawls from the teeth of the seat to control a rotational direction of the seat by the housing. The driving stem includes a narrower neck formed in the other end to form a head and to engage with and to drive tool elements. The provision of the narrower neck in the driving stem permits the driving stem to rotate relative to the tool elements.

12 Claims, 6 Drawing Sheets

RATCHET TOOL HAVING IMPROVED DRIVING SHANK

BACKGROUND OF THE INVENTION

1. Field of the Invention

The present invention relates to a ratchet tool, and more particularly to a ratchet tool having an improved driving shank for facilitating the driving operation of the ratchet tool.

2. Description of the Prior Art

Various kinds of typical ratchet tools have been developed and comprise an improved gear or internal gear and a pair of pawls moved radially or laterally toward the gear or the internal gear to control the operation directions of the ratchet tools.

For example, U.S. Pat. No. 5,570,616 to Thompson et al., U.S. Pat. No. 5,687,820 to Lin, and U.S. Pat. No. 6,047,802 to Huang disclose three of the typical ratchet screw drivers each including a similar ratchet mechanism to control the operation directions of the ratchet screw drivers.

However, the engagement between the radially or laterally moved pawls and the gear or the internal gear is weak, and thus may not sustain a great rotational driving torque. In addition, the driving stems or the driving tool members of the typical ratchet driving tools may not be changed or replaced with the other ones.

U.S. Pat. No. 5,964,132 to Chen discloses another typical driving tool having a number of shafts to be changeably attached to the driving members. However, no ratchet mechanisms may be disposed in the driving members, and a complicated retaining device is required to changeably attaché the shafts to the driving members.

U.S. Pat. No. 6,058,812 to Casel et al. discloses another typical driving tool having an improved handle, but having a complicated ratchet driving mechanism.

The present applicant has developed another typical driving tool, and disclosed in U.S. Pat. No. 6,622,597 to Chen, and including an improved ratchet driving mechanism. However, the driving shanks or the driving stems may not be rotated relative to the handle, such that the driving tool may not be suitably used for driving some of the fasteners.

The present invention has arisen to mitigate and/or obviate the afore-described disadvantages of the conventional ratchet tools.

SUMMARY OF THE INVENTION

The primary objective of the present invention is to provide a ratchet tool including an improved driving shank for facilitating the driving operation of the ratchet tool.

In accordance with one aspect of the invention, there is provided a ratchet tool comprising a housing including a pair of longitudinal channels formed therein, a seat rotatably secured to the housing and including a first end facing toward the housing and having a plurality of teeth formed therein, the seat including a cylindrical member extended therefrom and having an aperture formed therein, a driving stem engaged in the aperture of the cylindrical member, the driving stem including a first end having an engaging hole formed therein, a tool member received in the engaging hole of the driving stem, a pair of pawls slidably engaged in the longitudinal channels of the housing respectively, means for biasing the pawls to move longitudinally relative to the housing to engage with the teeth of the seat, and means for selectively disengaging the pawls from the teeth of the seat to control a rotational direction of the seat by the housing, and the driving stem including a second end having a narrower neck formed therein to define a head thereon, for engaging with and driving tool elements, a provision of the narrower neck in the second end of the driving stem permitting the driving stem to rotate relative to the tool elements.

The driving stem includes a driving member provided in the second end thereof, and spaced away from the head, to have the narrower neck formed between the driving member and the head. The head of the driving stem includes a projection provided therein to selectively engage with the tool elements, and to retain the tool elements to the head of the driving stem.

The driving stem includes a pathway formed therein to slidably receive the projection, and a rod slidably received in the pathway of the driving stem and having a depression formed therein to receive the projection to allow the projection to be disengaged from the tool elements, the projection is movable by the rod to engage with the tool elements when the rod is moved relative to the driving stem.

A moving device may further be provided for moving the rod relative to the driving stem, to move the projection toward and away from the tool elements. The moving device includes a button slidably received in the driving stem for engaging with and for moving the rod relative to the projection. The button includes an inclined surface formed therein, the rod includes an inclined surface formed therein and engaged with the inclined surface of the button, to allow the rod to be moved relative to the projection by the button.

The seat includes an orifice formed in the first end thereof, the housing includes a barrel rotatably secured in the orifice of the seat. The housing includes an outer peripheral portion having a passageway formed therein and communicating with the channels of the housing, and an actuator slidably received in the passageway of the housing and rotatable to engage with either of the pawls.

Each of the pawls includes a notch formed therein, the actuator includes two inclined ends engageable into the notches of the pawls. A control ferrule may further be provided and rotatably secured on the housing and may have the actuator secured thereto for moving the actuator along the passageway of the housing. The control ferrule includes three depressions formed therein, and a spring-biased projection engaged in the housing and selectively biased to engage with either of the depressions of the control ferrule.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
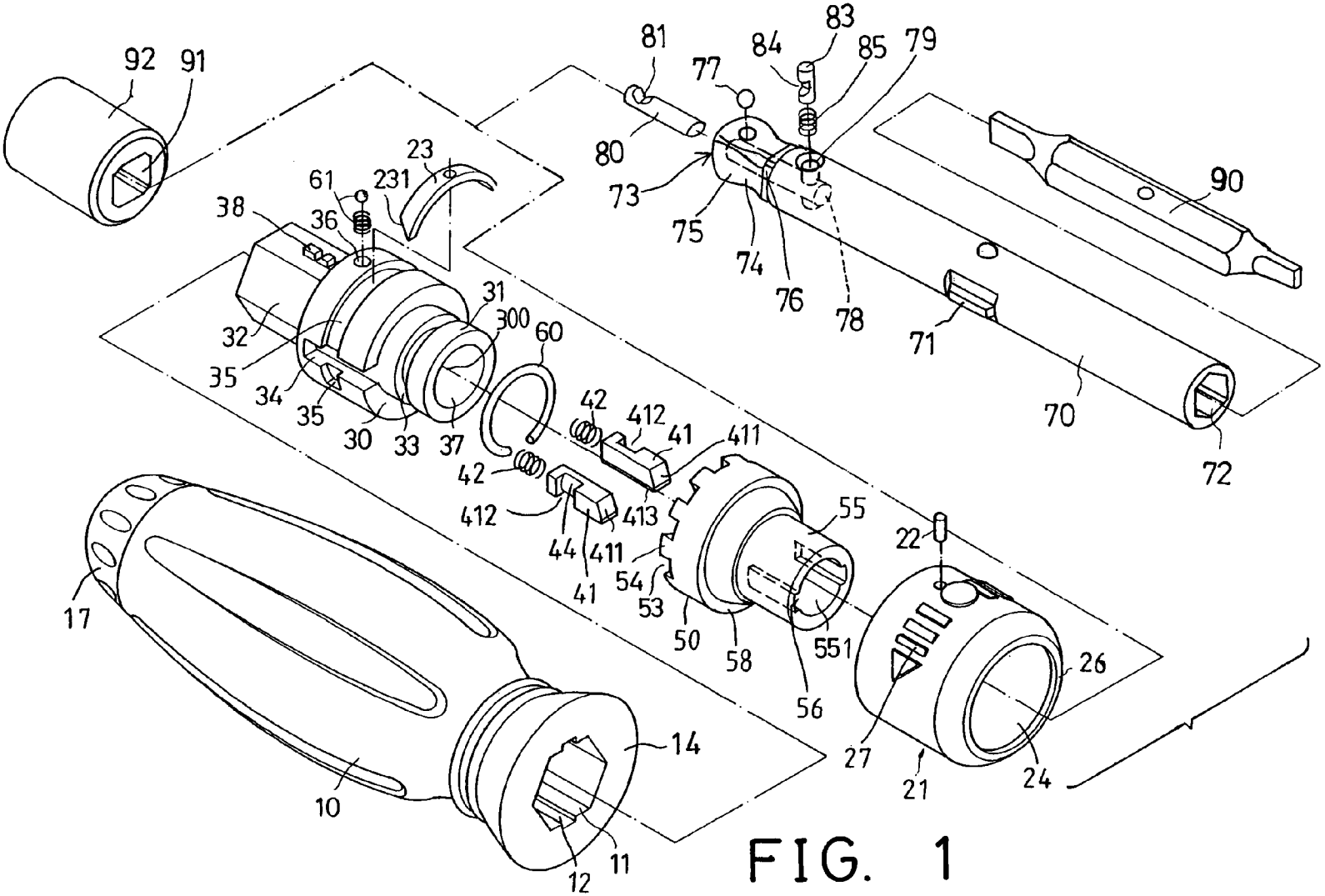
FIG. 1 is an exploded view of a ratchet tool in accordance with the present invention.

Referring to the drawings, and initially to FIGS. 1–5, a ratchet tool in accordance with the present invention comprises a handle 10 including a hole 11 and one or more slots 12 formed in one end thereof and communicating with each other and including a flat surface 14 formed in the end thereof. A cover 17 may be threaded to the rear end of the handle 10 to enclose the rear portion of the hole 11 of the handle 10.

A ratchet housing 30 is engaged with the flat surface 14 of the handle 10 and includes a bore 37 formed therein and includes an extension 32 extended from one end thereof and engaged into the hole 11 of the handle 10 and secured to the handle 10 with such as a force-fitted engagement, or the like.

The extension 32 and the mating hole 11 of the handle 10 include a mating non-circular cross section for allowing the housing 30 to be rotated in concert with the handle 10 and for allowing the housing 30 to be driven or rotated by the handle 10. The extension 32 of the housing 30 may further be secured to the handle 10 with one or more keys 38.

The housing 30 and the handle 10 may also be formed as a one-integral-piece structure, or the housing 30 may include the handle 10 extended from the housing 30. The housing 30 includes a barrel 31 extended from the other end thereof and having an outer diameter smaller than that of the housing 30 and having a peripheral groove 33 formed in the outer peripheral portion thereof for receiving a retaining ring 60 therein.

The housing 30 includes one or more, particularly two channels 34, formed in the outer peripheral portion thereof and parallel to the longitudinal axis 300 of the housing 30, for slidably receiving oen or more springs 42 and pawls 41 therein respectively. The housing 30 further includes a passageway 35 formed in the outer peripheral portion thereof and communicating with the channels 34 thereof, and includes a hole 36 formed in the outer peripheral portion thereof for receiving a spring-biased projection 61 therein.

Each of the pawls 41 includes a flat surface 413 formed in one side thereof, and an inclined surface 411 formed in one end thereof, and includes a notch 412 formed therein for communicating with the passageway 35 of the housing 30, and includes a curved bulge 44 formed or convex into the notch 412 thereof.

An actuator 23 is slidably received in the passageway 35 of the housing 30 and includes two inclined ends or includes two ends each having an inclined surface 231 formed therein for engaging with the pawls 41 and for moving the pawls 41 against the springs 42 respectively (FIS. 2, 5).

A control ferrule 21 includes a chamber 24 formed therein for rotatably receiving the housing 30 and includes a peripheral flange 26 extended radially inward of the chamber 24 from one end thereof. A fastener or a rivet or a fastener pin 22 is engaged through the control ferrule 21 and the actuator 23 for securing the actuator 23 to the control ferrule 21 and for allowing the actuator 23 to be moved by the control ferrule 21 to move along the passageway 35 of the housing 30 and to be engaged with the pawls 41.

The control ferrule 21 may thus be relatively or rotatably secured to the housing 30 with the sliding engagement of the actuator 23 in the passageway 35 of the housing 30, and/or may be limited to rotated relative to the housing 30 by the sliding engagement of the actuator 23 in the passageway 35 of the housing 30.

The control ferrule 21 includes three depressions 211, 212, 213 formed therein (FIGS. 2, 3, 5) for receiving the spring-biased projection 61 which may position and secure or retain the control ferrule 21 to the housing 30 at the required angular position. The control ferrule 21 includes a pattern or one or more arrows 27 or the like provided on the outer peripheral portion for decoration purposes and/or for indicating the rotational direction of the control ferrule 21 relative to the housing 30.

A rotary seat 50 is rotatably received in the chamber 24 of the control ferrule 21 and includes a peripheral shoulder 58 formed therein for engaging with the peripheral flange 26 of the control ferrule 21 and for rotatably retaining the seat 50 in the control ferrule 21 and for preventing the seat 50 from being disengaged from the control ferrule 21.

The seat 50 includes an orifice 51 formed therein (FIG. 4) for rotatably receiving the barrel 31 of the housing 30, and includes an annular recess 52 formed therein (FIG. 2) for receiving the retaining ring 60 which may rotatably secure the seat 50 to the barrel 31 of the housing 30. The seat 50 includes one end having a number of teeth 54 formed on the peripheral portion thereof (FIGS. 1, 4) and formed or defined between a number of cavities 53 of the seat 50. The pawls 41 may be biased by the springs 42 to engage with the teeth 54 of the seat 50.

Figure 2:
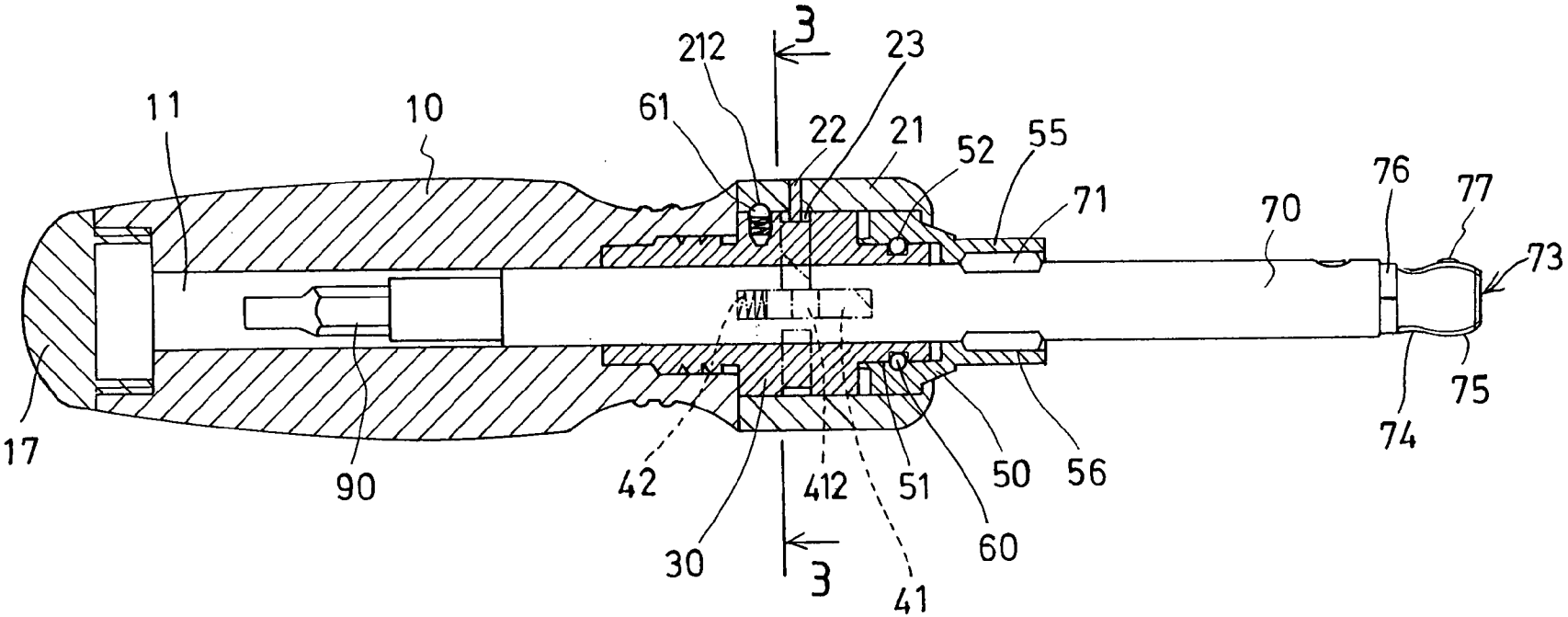
FIG. 2 is a cross sectional view taken along lines 2—2 of FIG. 3.
Figure 5:
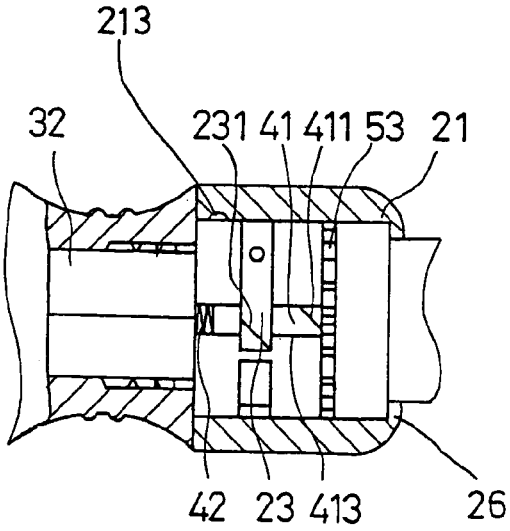
FIG. 5 is an enlarged partial cross sectional view of the ratchet tool.
Figure 4:
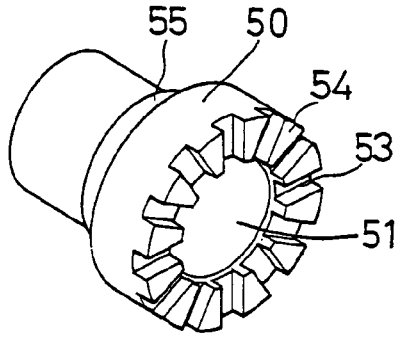
FIG. 4 is a perspective view of a seat.

As shown in dotted lines in FIG. 2, when the pawls 41 are biased to engage with the teeth 54 of the seat 50, the notch 412 of the pawl 41 is partially communicating with the passageway 35 of the housing 30, or aligned with the actuator 23 for allowing the inclined ends 231 of the actuator 23 to be engaged into the notches 412 of the pawls 41, and to move and disengage the pawls 41 from the teeth 54 of the seat 50 (FIG. 5).

Accordingly, the pawls 41 may be actuated and moved to engage with or to be disengaged from the teeth 54 of the seat 50 by the actuator 23. The control ferrule 21 may rotate the actuator 23 along the passageway 35 of the housing 30, to engage with either of the pawls 41.

The seat 50 includes a cylindrical member 55 extended therefrom and opposite to the teeth 54, and having an aperture 551 formed therein and communicating with the orifice 51 thereof (FIG. 2) for receiving a driving stem 70 therein, and having one or more grooves 56 longitudinal formed therein and communicating with the aperture 551 thereof.

The driving stem 70 may also extend through the bore 37 of the housing 30 and extend into the hole 11 of the handle 10. The driving stem 70 includes one or more nibs or projections 71 laterally extended therefrom and engaged into the grooves 56 of the cylindrical member 55 for detachably securing the driving stem 70 to the seat 50.

Figure 3:
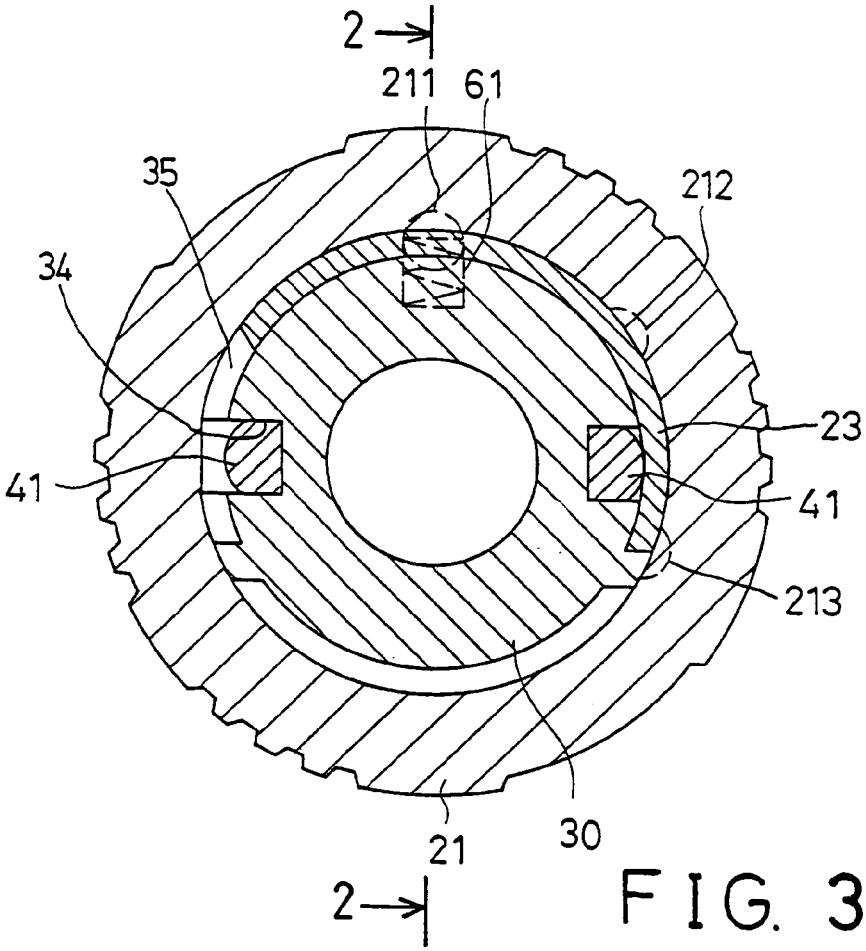
FIG. 3 is a cross sectional view taken along lines 3—3 of FIG. 2.

In operation, the pawls 41 may be biased by the springs 42 to engage with the teeth 54 of the seat 50. As shown in FIG. 3, the actuator 23 is secured to the control ferrule 21 and may be rotated to move along the passageway 35 of the housing 30. The ends 231 of the actuator 23 may thus be moved to engage with the pawls 41, and to move the pawls 41 toward and away from the seat 50.

When the control ferrule 21 is rotated to have the spring-biased projection 61 engaged in the middle depression 212 of the control ferrule 21, both the ends 231 of the actuator 23 may be disengaged from the pawls 41, such that the pawls 41 may both be biased to engage with the teeth 54 of the seat 50. At this moment, the seat 50 is solidly secured to the housing 30 with the pawls 41, such that the seat 50 and thus the driving stem 70 may be driven and rotated in both directions by the handle 10 via the housing 30.

As best shown in FIG. 3, when the actuator 23 is rotated relative to the housing 30 to have either of the ends 231 thereof to engage with the pawls 41, one of the pawls 41 may be disengaged from the teeth 54 of the seat 50 by the actuator 23 (FIG. 5) and the other pawl 41 may still be biased to engage with the teeth 54 of the seat 50.

When only one of the pawls 41 is engaged with the teeth 54 of the seat 50, and when the teeth 54 of the seat 50 are rotated or forced to engage with the flat surface 413 of the pawl 41, the pawl 41 will not be disengaged from the seat 50 such that the seat 50 and thus the driving stem 70 may be driven and rotated in an active direction by the handle 10 via the housing 30 and the pawl 41.

When the housing 30 is rotated in a reverse direction relative to the seat 50, the teeth 54 of the seat 50 may be caused to engage with the inclined surface 411 of the pawl 41 and may force the pawl 41 to be moved away from the teeth 54 of the seat 50 against the spring 42, such that the housing 30 may rotate freely relative to the seat 50 in the reverse direction, and such that the seat 50 and the driving stem 70 will not be driven or rotated in the reverse direction by the handle 10 and the housing 30.

It is to be noted that the pawls 41 are slidably received in the longitudinal channels 34 of the housing 30 and may be moved longitudinally to engage with the teeth 54 of the seat 50. The engagement area between the pawls 41 and the teeth 54 of the seat 50 may be relatively increased as compared with that of the typical ratchet tools, such that the pawls 41 may be solidly engaged with the teeth 54 of the seat 50.

The driving stem 70 includes an engaging hole 72 formed therein for changeably receiving one or more tool members 90, such as the tool bits, the fasteners, the tool shanks, or the like therein, such that the driving stem 70 may be used to selectively drive various kinds of tool bits or fasteners or tool shanks.

Figure 6:
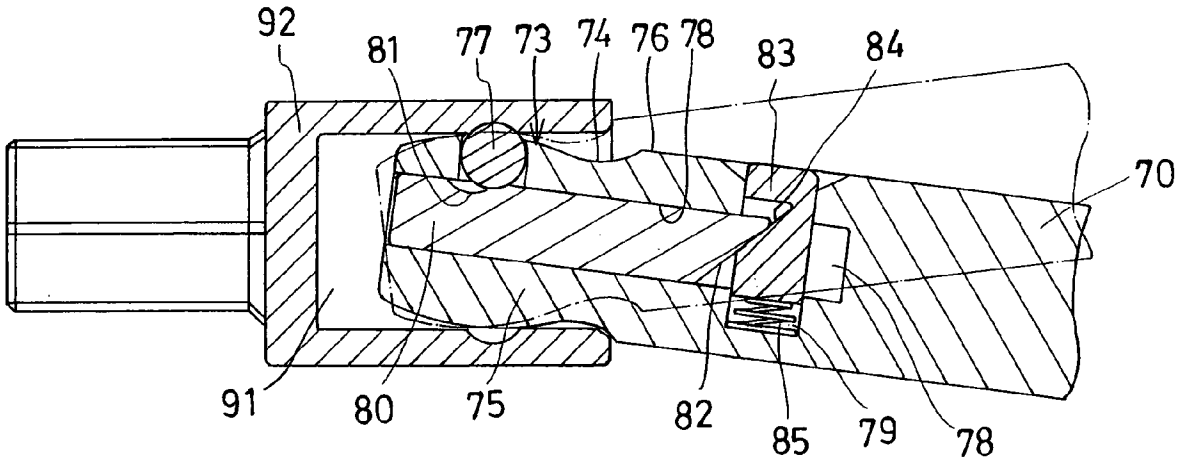
FIG. 6 is a partial cross sectional view illustrating the operation of the ratchet tool.
Figure 7:
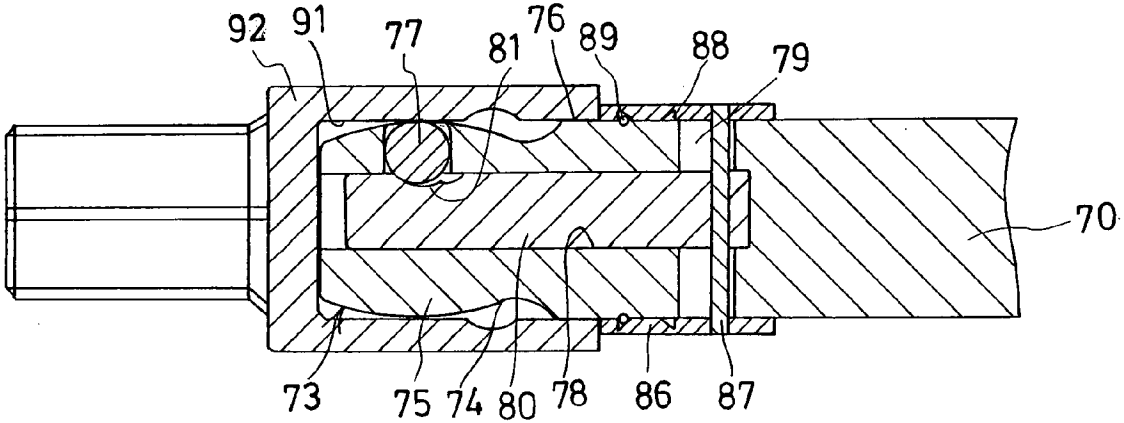
FIG. 7 is a partial cross sectional view similar to FIG. 6, illustrating the other arrangement of the ratchet tool.
Figure 8:
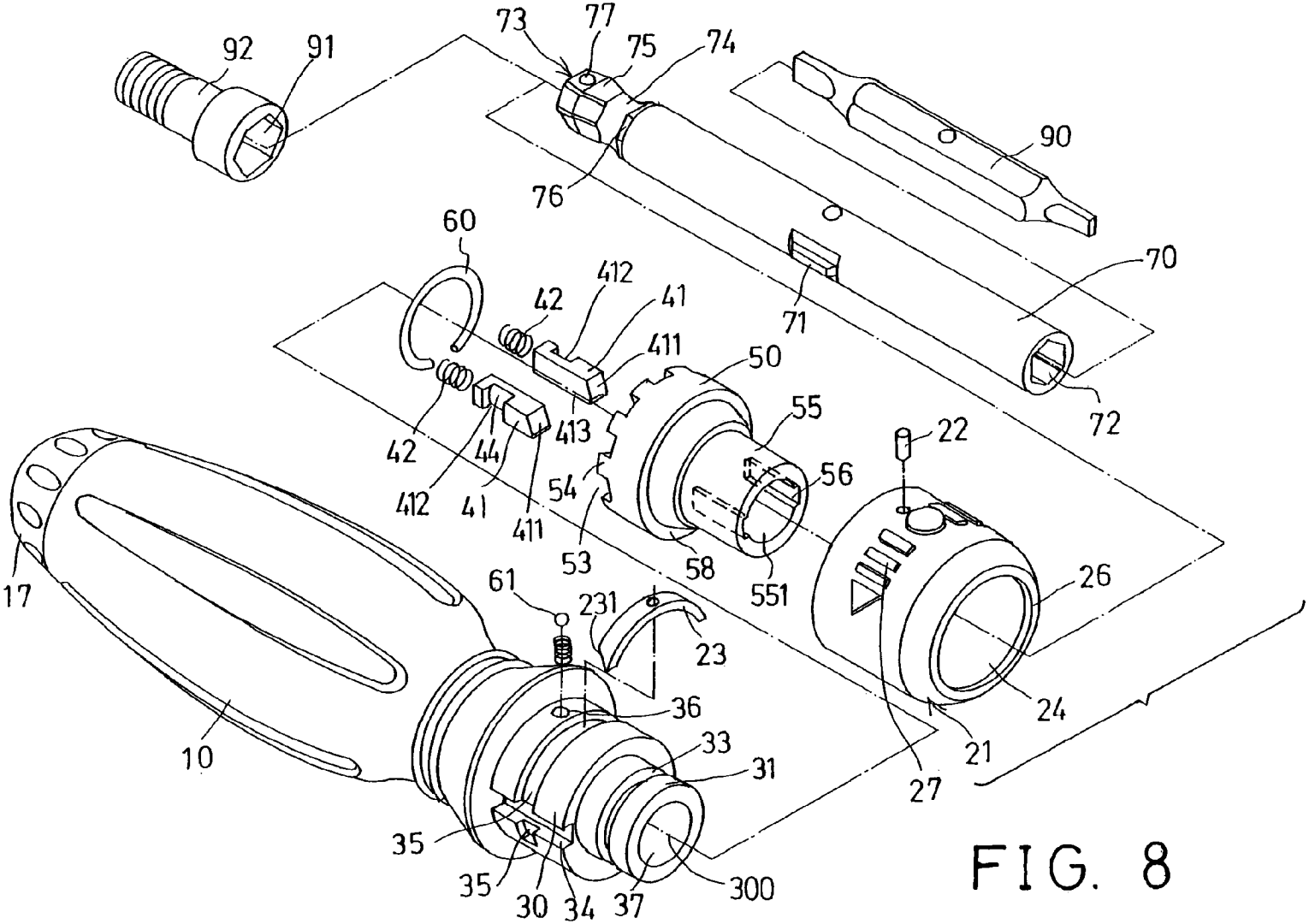
FIG. 8 is an exploded view similar to FIG. 1, illustrating the further arrangement of the ratchet tool.

Referring next to FIGS. 6–8 and again to FIGS. 1–2, the other end 73 of the driving stem 70 includes a narrower neck 74 formed therein to form or define a head 75 thereon. The head 75 may be engaged into an engaging hole 91 of a tool element 92, such as a socket 92 (FIGS. 1, 6, 7), a fastener (FIG. 8) or the like. The formation or the provision of the narrower neck 74 in the other end 73 of the driving stem 70 allows the driving stem 70 to be slightly rotated relative to the tool element 92 (FIG. 6), such that the tool element 92 may be easily driven or rotated by the driving stem 70.

The head 75 of the driving stem 70 may include a non-circular cross section, such as a square or a rectangular cross section as shown in FIG. 1, or a hexagonal cross section as shown in FIG. 8, or the like, for engaging into the corresponding non-circular engaging hole 91 of the tool element 92, to allow the tool element 92 to be driven or rotated by the head 75 of the driving stem 70. The driving stem 70 further includes a driving member 76 or one or more flat surfaces formed in the other end 73 thereof, and spaced away from the head 75, to have the narrower neck 74 formed or defined between the driving member 76 and the head 75.

In operation, as shown in FIG. 7, when the head 75 is further engaged into the engaging hole 91 of the tool element 92 to engage the driving member 76 into the engaging hole 91 of the tool element 92, the driving stem 70 may be solidly secure to the tool element 92, and may not be rotated relative to the tool element 92 at this moment, such that the tool element 92 may be solidly rotated or driven by the driving stem 70.

The head 75 of the driving stem 70 may further include a projection 77 engaged therein for engaging with the tool element 92, and for solidly securing or retaining the tool element 92 to the head 75 of the driving stem 70. For example, the driving stem 70 may include a pathway 78 formed therein, to receive the projection 77, and to allow the projection 77 to be disengaged from the tool element 92 (FIG. 7).

A rod 80 is slidably received in the pathway 78 of the driving stem 70, and includes a depression 81 formed therein to receive the projection 77, and to allow the projection 77 to be disengaged from the tool element 92. In addition, when the rod 80 is moved relative to the projection 77, the projection 77 may be forced by the rod 80 to engage with the tool element 92 (FIG. 6), and thus to secure or retain the tool element 92 to the head 75 of the driving stem 70.

The driving stem 70 may further include a conduit 79 formed therein, and intersecting or communicating with the pathway 78 of the driving stem 70, to slidably receive a button 83 therein. The button 83 includes an inclined surface 84 formed therein to engage with a corresponding inclined surface 82 of the rod 80, to move the rod 80 relative to the projection 77, and to actuate the projection 77 to engage with or to be disengaged from the tool element 92. A spring 85 may be received in the conduit 79 of the driving stem 70, to bias the button 83 and thus the rod 80 to force the projection 77 to engage with the tool element 92.

Alternatively, as shown in FIG. 7, a sleeve 86 may be engaged onto the driving stem 70, and coupled to the rod 80 with a link 87, in order to move the rod 80 relative to the projection 77. The sleeve 86 may include two peripheral grooves 88 formed therein. A clamping or retaining ring 89 may be engaged onto the driving stem 70 and may be engaged into either of the peripheral grooves 88 of the sleeve 86, to position the sleeve 86 to the driving stem 70, and to maintain the projection 77 in engagement with or in disengagement from the tool element 92.

Figure 9:
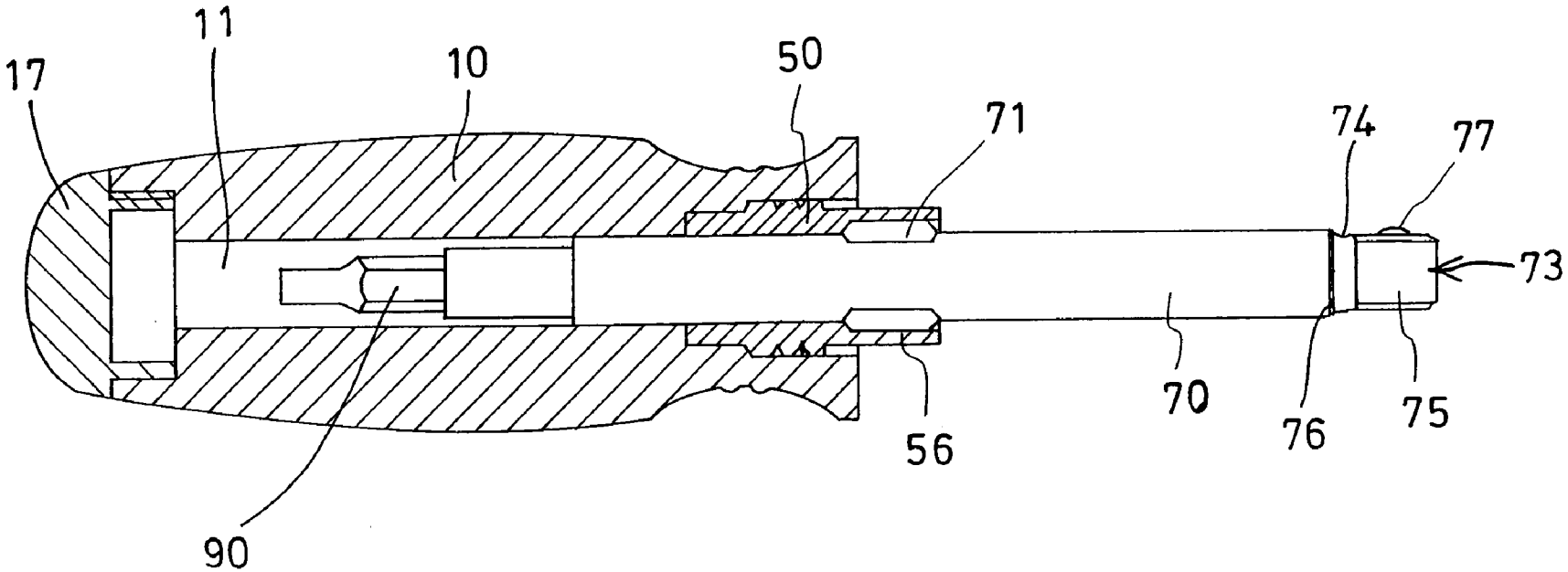
FIG. 9 is a cross sectional view similar to FIG. 2, illustrating the still further arrangement of the ratchet tool.

As shown in FIG. 9, the driving stem 70 may be directly attached to the handle 10 with or without the seat 50, and the provision of the narrower neck 74 in the other end 73 of the driving stem 70 allows the driving stem 70 to be slightly rotated relative to the tool element 92, and thus to easily drive or rotate the tool element 92.

Accordingly, the ratchet tool in accordance with the present invention includes an improved driving shank for facilitating the driving operation of the ratchet tool.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet tool comprising:

a housing including a pair of longitudinal channels formed therein, a seat rotatably secured to said housing and including a first end facing toward said housing and having a plurality of teeth formed therein, said seat including a cylindrical member extended therefrom and having an aperture formed therein, a driving stem engaged in said aperture of said cylindrical member, said driving stem including a first end having an engaging hole formed therein, a tool member received in said engaging hole of said driving stem, a pair of pawls slidably engaged in said longitudinal channels of said housing respectively, means for biasing said pawls to move longitudinally relative to said housing to engage with said teeth of said seat, and means for selectively disengaging said pawls from said teeth of said seat to control a rotational direction of said seat by said housing, and said driving stem including a second end having a narrower neck formed therein to define a head thereon, for engaging with and driving tool elements, a provision of said narrower neck in said second end of said driving stem permitting said driving stem to rotate relative to the tool elements.

2. The ratchet tool according to claim 1, wherein said driving stem includes a driving member provided in said second end thereof, and spaced away from said head, to have said narrower neck formed between said driving member and said head.

3. The ratchet tool according to claim 1, wherein said head of said driving stem includes a projection provided therein to selectively engage with the tool elements, and to retain the tool elements to said head of said driving stem.

4. The ratchet tool according to claim 3, wherein said driving stem includes a pathway formed therein to slidably receive said projection, and a rod slidably received in said pathway of said driving stem and having a depression formed therein to receive said projection to allow said projection to be disengaged from the tool elements, said projection is movable by said rod to engage with the tool elements when said rod is moved relative to said driving stem.

5. The ratchet tool according to claim 4 further comprising means for moving said rod relative to said driving stem, to move said projection toward and away from the tool elements.

6. The ratchet tool according to claim 5, wherein said moving means includes a button slidably received in said driving stem for engaging with and for moving said rod relative to said projection.

7. The ratchet tool according to claim 6, wherein said button includes an inclined surface formed therein, said rod includes an inclined surface formed therein and engaged with said inclined surface of said button, to allow said rod to be moved relative to said projection by said button.

8. The ratchet tool according to claim 1, wherein said seat includes an orifice formed in said first end thereof, said housing includes a barrel rotatably secured in said orifice of said seat.

9. The ratchet tool according to claim 1, wherein said housing includes an outer peripheral portion having a passageway formed therein and communicating with said channels of said housing, and an actuator slidably received in said passageway of said housing and rotatable to engage with either of said pawls.

10. The ratchet tool according to claim 9, wherein each of said pawls includes a notch formed therein, said actuator includes two inclined ends engageable into said notches of said pawls.

11. The ratchet tool according to claim 9 further comprising a control ferrule rotatably secured on said housing and having said actuator secured thereto for moving said actuator along said passageway of said housing.

12. The ratchet tool according to claim 11, wherein said control ferrule includes three depressions formed therein, and a spring-biased projection engaged in said housing and selectively biased to engage with either of said depressions of said control ferrule.

* * * * *